US006234548B1

(12) United States Patent
Mittelbach et al.

(10) Patent No.: US 6,234,548 B1
(45) Date of Patent: May 22, 2001

(54) PULL HANDLE FOR MOTOR-VEHICLE DOOR LATCH

(75) Inventors: Stephan Mittelbach; Michael Strathmann, both of Velbert; Stefan Uecker, Ratingen, all of (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 09/430,260

(22) Filed: Oct. 29, 1999

(30) Foreign Application Priority Data

Oct. 31, 1998 (DE) ..... 298 19 472 U

(51) Int. Cl.[7] ..... E05B 3/00

(52) U.S. Cl. ..... 292/336.3; 292/348; 292/DIG. 53

(58) Field of Search ..... 292/336.3, 348, 292/350, DIG. 31, DIG. 53

(56) References Cited

U.S. PATENT DOCUMENTS

| | | | | |
|---|---|---|---|---|
| 2,485,000 | * | 10/1949 | Jakeway | 292/267 |
| 4,883,296 | * | 11/1989 | Laurie | 292/336.3 |
| 5,725,262 | | 3/1998 | Kritzler . | |
| 5,791,703 | * | 8/1998 | Kritzler | 292/336.3 |
| 6,067,869 | * | 5/2000 | Chilla | 74/96 |
| 6,141,914 | * | 11/2000 | Feige | 49/503 |

* cited by examiner

*Primary Examiner*—B. Dayoan
*Assistant Examiner*—Gary Estremsky
(74) *Attorney, Agent, or Firm*—Herbert Dubno; Andrew Wilford

(57) ABSTRACT

A motor-vehicle door-latch handle assembly has a mounting plate, an elongated handle having a rear end pivoted in the mounting plate and a front end formed with a horizontally and transversely projecting actuation arm having a hook end. The handle is pivotal on the plate between an inner position with the front end resting against the door and an outer position with the front end pulled horizontally out of the door. A coupling element is pivoted on the door about a horizontal axis and has one radially projecting coupling arm engageable with the hook end of the handle, another radially projecting coupling arm, and a radially projecting abutment formation. A link extends vertically between the other coupling arm and the latch so that when the handle is displaced into the outer position the element is pivoted and the link is displaced vertically to actuate the latch. A spring rotationally urges the coupling element such that the one coupling arm bears on the hook end and biases the handle into the inner position. A lever pivotal on the plate has one lever arm movable into and out of a blocking position angularly engaging the abutment formation and blocking rotation of the coupling element and inward movement of the one coupling arm and another lever arm. A holding pin displaceable on the door is engageable with the other lever arm for displacing the one lever arm into the freeing position.

7 Claims, 3 Drawing Sheets

PULL HANDLE FOR MOTOR-VEHICLE DOOR LATCH

FIELD OF THE INVENTION

The present invention relates to a pull handle for a motor-vehicle door latch. More particularly this invention concerns mechanism facilitating installation of such a handle.

BACKGROUND OF THE INVENTION

A standard motor-vehicle door latch as described in has a latch mounted on the door edge and comprising a pivotal lock fork that can engage in a closed position around a doorpost-mounted bolt to retain the door shut, a retaining pawl engageable with the bolt and movable between a holding position with the bolt held in the closed position and a freeing position allowing the fork to pivot into an open position in which the bolt can move freely out of or into the latch, at least one actuating lever that is connected to the pawl to operate it, and at least one locking lever that can block or disconnect the actuating lever. An actuator for the latch is mounted somewhat above the latch on an outer surface or panel of the door and typically comprises a mounting plate itself fixed to the door and a handle that can be moved relative to the plate. A linkage is provided between the handle and the actuating lever so that movement of the handle is transmitted to the lever to operate the latch.

In commonly owned U.S. Pat. No. 5,725,262 the door latch has a vertically displaceable actuating element serving to open the latch. An actuating system for the latch has a handle, a mounting plate supporting the handle on the door above the latch, and a pivot on the mounting plate for horizontal movement of the handle on the plate between an unactuated position generally flush with the door and an actuated position spaced horizontally outward from the door. A coupling lever pivoted on the door about a horizontal axis has one arm connected to the handle and another arm. A link extends vertically between the other arm and the actuating element so that when the handle is displaced horizontally into the actuated position the lever is pivoted and the link is displaced vertically.

To assembly such a system the mounting plate carrying the coupling lever is mounted on the inner face of the outside panel of the door and secured in place by screws. The door latch is screwed to the edge of the door, that is the part of the door that engages the door post, and is coupled by the link to the lever. The coupling lever is held by means of a return spring in its starting position, with an arm to be engaged by the handle at a spacing inward from the outside door panel. During assembly the handle is fitted through appropriate holes in the outside door panel and fitted to the mounting plate, then shifted into its final position so that the fork on the pivot end of the handle fits over its pivot pin and the engagement hook on the arm of the handle slips behind the one arm of the coupling lever. After such mounting of the handle a retaining hook is slipped under the outside door panel and secured in place on the opposite end with a screw to retain the handle.

In the known latch the handle is provided between its ends with a relatively short finger-protecting bump. The function of this structure is to prevent the user's fingers from getting pinched between the handle and the door panel. The height of the protecting bump is limited so that it does not interfere with insertion of the entrainment hook through the hole in mounting plate for sliding behind the first arm of the coupling lever. In order to avoid that the protecting bump engages the outer face of the door the other arm of the coupling lever must be manually pushed back to pivot the lever against its return spring. This constitutes another assembly step that slows production of the vehicle because the first arm of the coupling lever must be held from inside while the handle is installed from outside, making the assembly a tricky two-handed operation that would require a further step in production or an overall slowing of production.

OBJECTS OF THE INVENTION

It is therefore an object of the present invention to provide an improved pull handle for a motor-vehicle door latch.

Another object is the provision of such an improved pull handle for a motor-vehicle door latch which overcomes the above-given disadvantages, that is which can be assembled easily and which has an improved finger-protecting bump.

SUMMARY OF THE INVENTION

A motor-vehicle door latch mounted on a door is operated by a handle assembly according to the invention that has a mounting plate, an elongated handle having a rear end pivoted in the mounting plate and a front end formed with a horizontally and transversely projecting actuation arm having a hook end and, offset inward from the actuation arm, a horizontally and transversely projecting finger-guard formation. The handle is pivotal on the plate between an inner position with the front end resting against the door and an outer position with the front end pulled horizontally out of the door. A coupling element is pivoted on the door about a horizontal axis and has one radially projecting coupling arm engageable with the hook end of the handle, another radially projecting coupling arm, and a radially projecting abutment formation. A link extends vertically between the other coupling arm and the latch so that when the handle is displaced into the outer position the element is pivoted and the link is displaced vertically to actuate the latch. A spring rotationally urges the coupling element such that the one coupling arm bears on the hook end and biases the handle into the inner position. A lever pivotal on the plate has one lever arm movable into and out of a blocking position angularly engaging the abutment formation and blocking rotation of the coupling element and inward movement of the one coupling arm and another lever arm. A holding pin displaceable on the door is engageable with the other lever arm for displacing the one lever arm into the freeing position.

With this system the finger-guard formation can be relatively long so that it is impossible for the user's fingers to get pinched between the front end of the handle and the door panel. Nonetheless since the lever can hold the coupling element in an outwardly rotated position, the latch can be assembled wholly from outside the door. Once the handle is in place, the holding pin is operated to release the lever and set the lock by allowing the element to pivot to press its one arm against the outside face of the hook of the handle.

The lever according to the invention is pivotal about an axis extending generally perpendicular to a plane including a pivot axis of the element. In addition one coupling arm is L-shaped and a spring bears against the one lever and urges it into the blocking position.

The holding pin in accordance with the invention has an inner end permanently coupled to the other lever arm. More particularly the other lever arm is formed with an elongated slot and the pin inner end has a crosswise coupling pin engaged in the slot.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
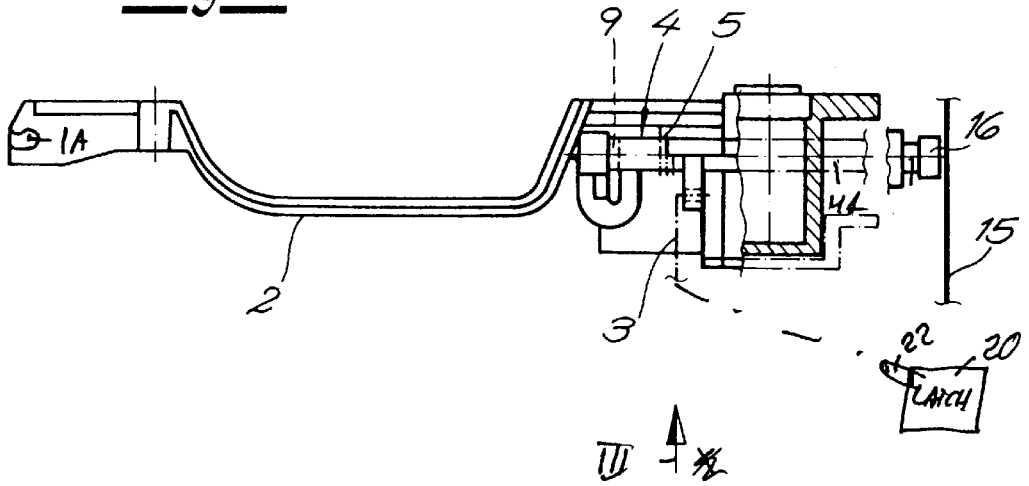
FIG. 1 is a top partly sectional view of the handle assembly according to the invention.

As seen in FIGS. 1 to 5 a motor-vehicle door latch 20 is operated by an outside handle 1 that is pivoted about a vertical axis 1A in a plate 2 mounted on a door outer panel 21. A link rod 3 connects the latch 20 to an arm 23 of a coupling shaft 4 pivotal about a horizontal axis 4A on the plate 2. A torque-type return spring 5 braced between the shaft 4 and a fixed point on the plate 2 urges it continuously rotationally into a starting position described below. The handle 1 is cast in one piece of metal and has a transversely projecting actuating arm 6 formed with a hook 7 and a body indicated generally at G. Adjacent the arm 6 is a transversely projecting finger-protecting bump 8 that prevents a hand engaged around the body G from slipping and getting pinched against the door panel 21.

Figure 5:
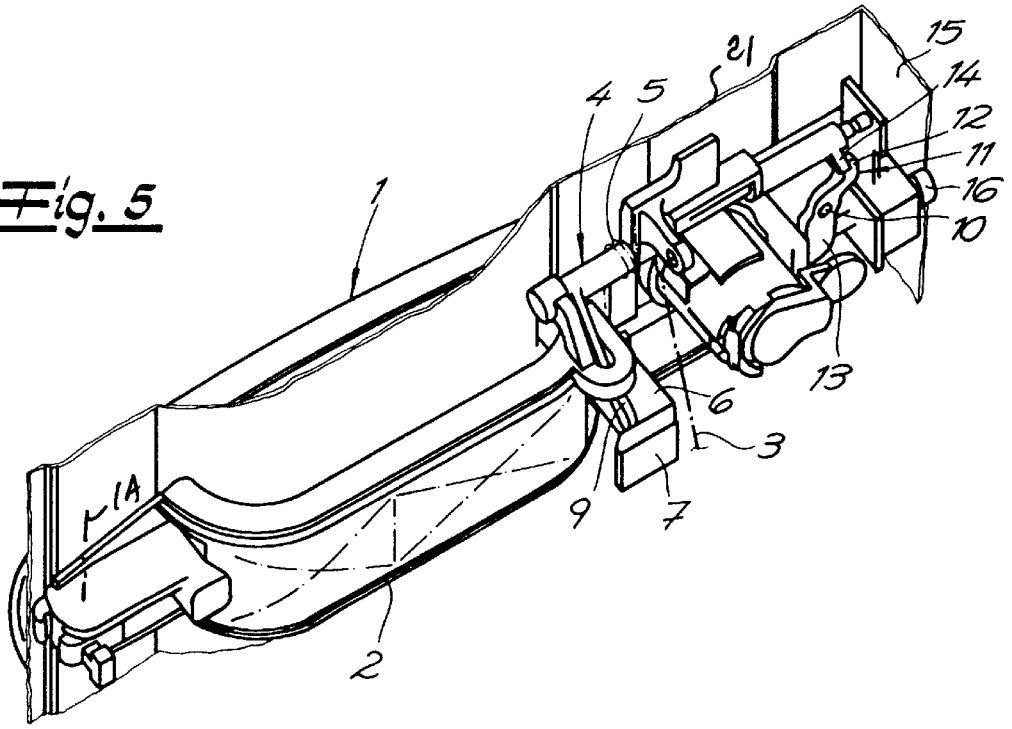

The coupling shaft 4 has a radially projecting arm 9 that engages behind the hook 7 and that therefore couples the handle 1 to the latch 20 via the link 3, converting the horizontal movement of the handle 1 into a vertical movement of the link 3 as discussed in above-cited U.S. Pat. No. 5,725,262. The spring 5 urges the shaft 4 rotationally about its horizontal axis 4A such that the outer (lower in FIG. 3) end of the arm 9 is biased inward in direction D (up out of the plane of the view on FIG. 3) so as to engage behind the hook 7 of the handle 1 as shown in FIG. 5 and pull this handle 1 into the illustrated inner position pressed against the outer face of the outer door panel 21. If the handle 1 is pulled outward, pivoting it about its vertical axis 1A, the arm 9 is pivoted back in against the direction D to pivot the shaft 4 about its axis 4A and press down the link 3, operating the outside-actuation 22 arm of the latch 20. Presuming the latch 20 is unlocked, that is the outside actuation arm 22 is connected to the release pawl, this action will open the door having the outside panel 21.

According to the invention a lever 11 having two arms 12 and 13 is pivoted on the plate 2 at a pin 10 defining a pivot axis 11A perpendicular to a plane including the axis 4A. In addition the shaft 4 has a third arm or formation 14 that can engage the outer end of the L-shaped or offset arm 12 and the lever 11 is urged by a spring shown schematically at 24 into the position of FIG. 3 with the outer end of the arm 12 lying in the path of the arm 14 and blocking pivoting of the shaft 4A under the effect of the spring 5. A holding pin or screw 16 accessible through a door edge panel 15 has a shaft 17 provided with a crosswise coupling pin 19 engaged in a slot 18 in the other arm 13 of the lever 11. This screw-shaft 16, 17 can move parallel to the axis 4A to pivot the lever 11 against the force of its spring 24 and move the outer end of the arm 12 out of the path of the formation 14.

Figure 2:
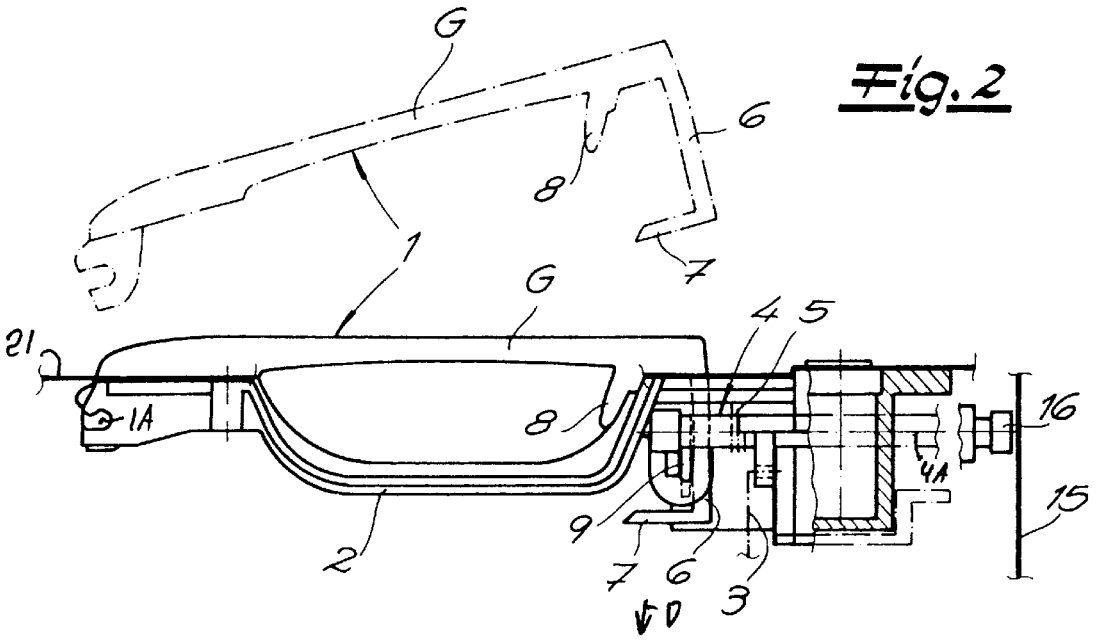
FIG. 2 is a view like FIG. 1 but showing how the assembly is put together.
Figure 3:
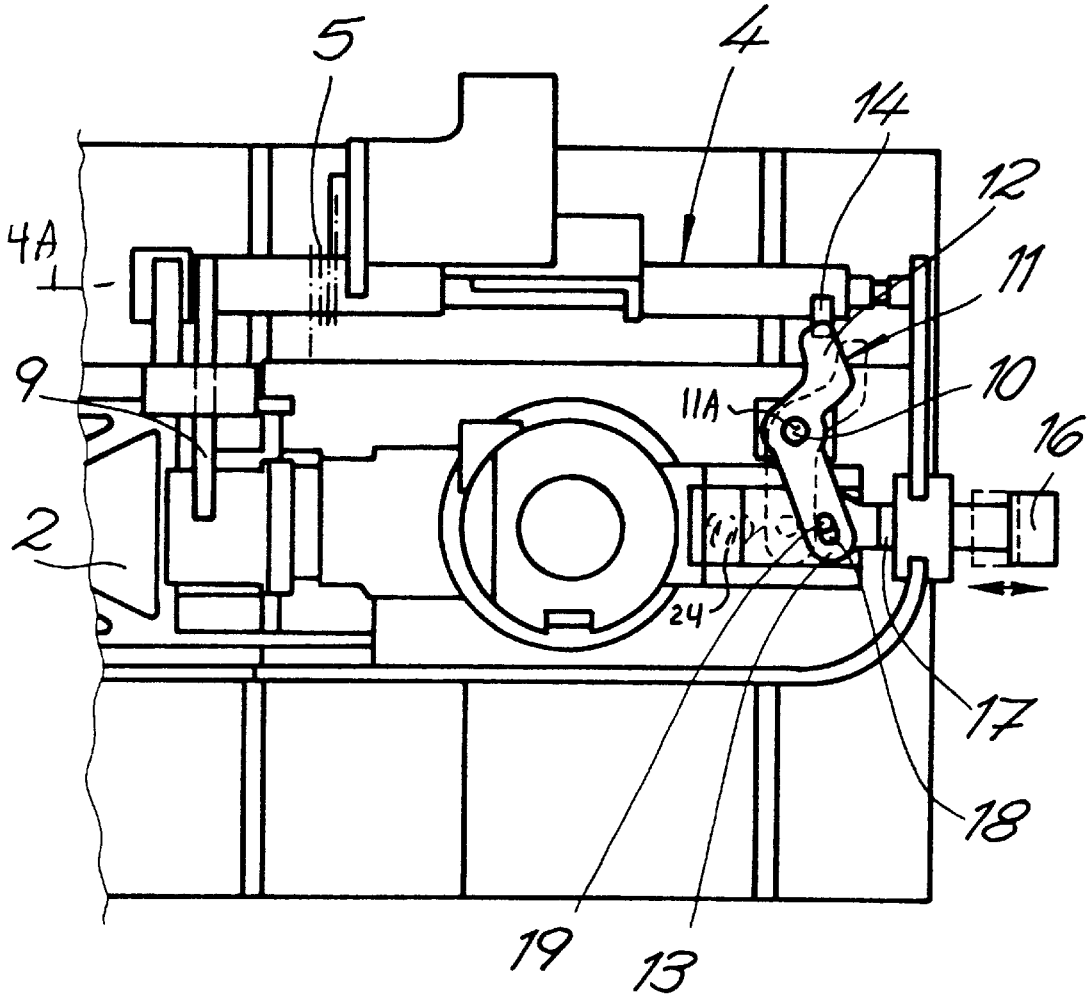
FIG. 3 is a large-scale view of the structure taken in the direction of arrow III of FIG. 1.
Figure 4:
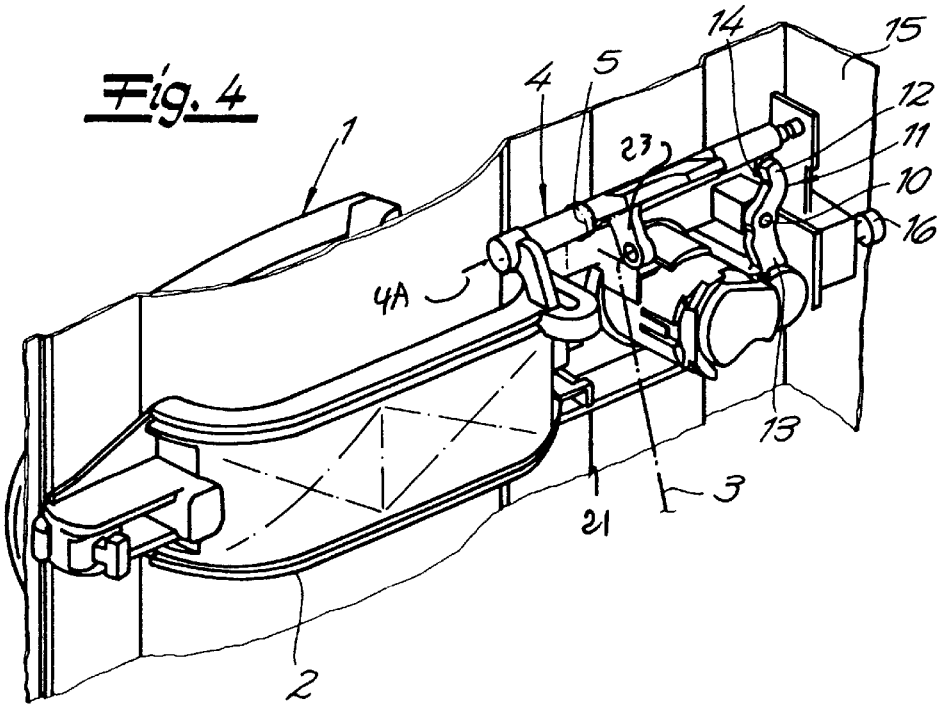
FIGS. 4 and 5 are succeeding steps in the assembly of the latch in accordance with the invention.

Thus when the latch assembly is constructed it is set as shown in FIGS. 3 and 4 with the screw 16 out and the arm 12 blocking rotation of the shaft 4, holding the outer end of the arm 9 in toward the outer panel 21. In this position it is relatively easy to mount the handle 1 on the assembly by first fitting it into the door in the direction D, and then shifting it parallel to the axis 4A to fit the forked end of the handle 1 over its pivot 1A and slipping the hook 7 behind the retracted arm 9 as shown in FIG. 2. Then the handle 1 is further secured, normally by an unillustrated screw, so it cannot fall out.

Once the handle is in place the screw 16 is driven in to pivot the lever 11 clockwise as shown in FIG. 3 about its axis 11A and thereby free the formation 14 so the shaft 4 can rotate and press the free end of the arm against the back of the hook as shown in FIG. 5.

We claim:

1. In combination with a motor-vehicle door latch mounted on a door, a handle assembly comprising:

a mounting plate;

an elongated handle having a rear end pivoted in the mounting plate and a front end formed with a horizontally and transversely projecting actuation arm having a hook end and, offset inward from the actuation arm, a horizontally and transversely projecting finger-guard formation, the handle being pivotal on the plate between an inner position with the front end resting against the door and an outer position with the front end pulled horizontally out of the door;

a coupling element pivoted on the door about a horizontal axis and having one radially projecting coupling arm engageable with the hook end of the handle, another radially projecting coupling arm, and a radially projecting abutment formation;

a link extending vertically between the other coupling arm and the latch, whereby when the handle is displaced into the outer position the element is pivoted and the link is displaced vertically to actuate the latch;

a spring rotationally urging the coupling element such that the one coupling arm bears on the hook end and biases the handle into the inner position;

a lever pivotal on the plate and having two lever arms, one of the lever arms movable into and out of a blocking position angularly engaging the abutment formation and blocking rotation of the coupling element and inward movement of the one coupling arm and a holding pin displaceable on the door and engageable with the other lever arm for displacing the one lever arm into the freeing position.

2. The handle assembly defined in claim 1 wherein the lever is pivotal about an axis extending generally perpendicular to a plane including a pivot axis of the element.

3. The handle assembly defined in claim 1 wherein one coupling arm is L-shaped.

4. The handle assembly defined in claim 1, further comprising spring means bearing against the one lever and urging it into the blocking position.

5. The handle assembly defined in claim 4 wherein the pin has an inner end permanently coupled to the other lever arm.

6. The handle assembly defined in claim 5 wherein the other lever arm is formed with an elongated slot and the pin inner end has a crosswise coupling pin engaged in the slot.

7. The handle assembly defined in claim 1 wherein the pin is movable along an axis coplanar with the axis of the element and the lever is pivotal about an axis generlaly perpendicular to a plane ncluding the axes of the element and of the lever.

* * * * *